US008037925B2

(12) United States Patent
Oh et al.

(10) Patent No.: US 8,037,925 B2
(45) Date of Patent: Oct. 18, 2011

(54) HEAT EXCHANGER HAVING INTEGRATED TANK HEADER AND PARTITION STRUCTURE AND PARTITION INSERTING GROOVE WITH LEAK DETECTION

(75) Inventors: Kwang Hun Oh, Daejeon (KR); Hong-Young Lim, Daejeon (KR); Li-Yong Park, Daejeon (KR)

(73) Assignee: Halla Climate Control Corp., Daejeon (KR)

( * ) Notice: Subject to any disclaimer, the term of this patent is extended or adjusted under 35 U.S.C. 154(b) by 951 days.

(21) Appl. No.: 12/007,494

(22) Filed: Jan. 11, 2008

(65) Prior Publication Data

US 2008/0169085 A1 Jul. 17, 2008

(30) Foreign Application Priority Data

Jan. 12, 2007 (KR) ..... 10-2007-0003571

(51) Int. Cl.

| | |
|---|---|
| ***B60H 1/00*** | (2006.01) |
| ***F28D 1/04*** | (2006.01) |
| ***F28D 7/10*** | (2006.01) |
| ***H01L 23/467*** | (2006.01) |

(52) U.S. Cl. ..... 165/11.1; 165/151; 165/173; 165/153; 165/201

(58) Field of Classification Search ..... 165/11.1, 165/66, 151, 153, 156, 173, 201, 210, 213
See application file for complete search history.

(56) References Cited

U.S. PATENT DOCUMENTS

| | | | | |
|---|---|---|---|---|
| 6,672,379 | B1 * | 1/2004 | Wang et al. | 165/185 |
| 7,222,501 | B2 * | 5/2007 | Cho et al. | 62/515 |
| 7,273,093 | B2 * | 9/2007 | Durr et al. | 165/176 |
| 2005/0211425 | A1 * | 9/2005 | McKittrick et al. | 165/174 |

FOREIGN PATENT DOCUMENTS

| | | |
|---|---|---|
| JP | 2005-265356 | 9/2005 |
| JP | 2006-205718 | 8/2006 |
| WO | WO 2004005827 A1 * | 1/2004 |

* cited by examiner

*Primary Examiner* — Judy Swann
*Assistant Examiner* — Jason Thompson
(74) *Attorney, Agent, or Firm* — Lowe Hauptman Ham & Berner

(57) ABSTRACT

The present invention relates to a heat exchanger, and more particularly, to a heat exchanger in which a partition wall integrally formed with a header is fixedly inserted into a partition inserting groove of a tank and it is easy to check leakage of a heat exchange medium between the tank and the partition wall through a leakage checking hole formed in the partition inserting groove.

7 Claims, 10 Drawing Sheets

HEAT EXCHANGER HAVING INTEGRATED TANK HEADER AND PARTITION STRUCTURE AND PARTITION INSERTING GROOVE WITH LEAK DETECTION

TECHNICAL FIELD

The present invention relates to a heat exchanger, and more particularly, to a heat exchanger in which a partition wall integrally formed with a header is fixedly inserted into a partition inserting groove of a tank and it is easy to check leakage of a heat exchange medium between the tank and the partition wall through a leakage checking hole formed in the partition inserting groove.

BACKGROUND ART

In general, a heat exchanger is provided with a passage through which a heat exchange medium such as coolant or refrigerant can flow, and performs a heat exchange with the outside air while the heat exchange medium flows through the passage.

For example, the refrigerant compressed by a compressor and thus having a raised temperature is moved to a condenser. The temperature of the refrigerant is lowered by a heat exchange while the refrigerant passes through the condenser and is further lowered while the refrigerant passes through an expansion valve. After that, the refrigerant at the lowered temperature is moved to an evaporator.

In the evaporator, the heat exchange is performed to generate cool air. The cool air is then supplied to a room. In this case, a cooling operation is performed.

Meanwhile, coolant which has cooled a heated engine is moved to a heater core to perform a heat exchange. Warm air is generated by the heat exchange and then supplied to a room. In this case, a heating operation is performed.

A general heat exchanger is shown in FIGS. 1 and 2. A plurality of tubes 130 provided with a flow path 131 for a heat exchange medium therein are coupled with radiating fins 140 and each end portion of the tube 130 is inserted into and coupled to tube inserting holes 121 of a header 120. The header 120 is coupled with a tank 110.

At this time, the tube 130 and the header 120, and the header 120 and the tank 110 are respectively coupled by brazing.

The brazing is a joining method in which a filler material having a melting temperature of more than 450° C. is located at a joint portion of a base metal to be joined and heated to more than 450° C. and the molten filler material is then flowed into the joint portion of the base metal to join the joint portion, and is widely used in industrial fields since it has advantages that it is possible to join different kinds of metals, the joining strength is strong and the sealing property and the corrosion-resistance are excellent.

An end portion of the partition wall 122 which is in contact with the tank 110 is also joined with the tank 110 by the brazing. In this case, a joint area where the partition wall 122 and the tank 110 are in contact with each other is small. Therefore, the joining force is weak and the joining process is difficult, which leads to generation of many defects.

Also, since it is impossible to check the joint portion where the partition wall 122 and the tank 110 are in contact with each other from the outside, it is difficult to check the generation of the defect. Further, although it is possible to check the generation of the defect, it is impossible to find the exact position where the defect is generated.

If perfect sealing is not ensured between the partition wall 122 and the tank 110 as described in above, there are problems that the heat exchange medium does not flow through the given passage but flow abnormally, and the abnormally flowing heat exchange medium obstructs the normal flow of the heat exchange medium and causes a lowering in a heat exchange performance of the heat exchanger.

DISCLOSURE OF THE INVENTION

It is an object of the present invention to provide a heat exchanger in which a partition inserting groove is formed at a portion of a tank which is in contact with a partition wall and an upper end portion of the partition wall is jointly inserted into the partition inserting groove to ensure a secure joining.

It is another object of the present invention to provide a heat exchanger in which a leakage checking hole which passes through from the inside of the partition inserting groove to the outside of the partition inserting groove is formed in the partition inserting groove and it is therefore easy to check a leakage of a heat exchange medium between a header and the partition wall.

Hereinafter, the present invention is described in detail.

In order to achieve the above objects, there is provided a heat exchanger comprising a plurality of tubes which are arranged in parallel at a predetermined distance to be parallel with the direction of air flow and used as a flow path for a heat exchange medium; a plurality of radiating fins which are interposed between the tubes; headers which are formed with a plurality of tube inserting holes into which each end portion of the tube is fixedly inserted; a tanks which is coupled with an upper portion of the headers and used as a passage for the heat exchange medium; at least one partition wall which is integrally formed with the header and partitions the passage for the heat exchange medium; a partition inserting groove which is formed in a longitudinal direction of the tank so as to jointly insert the upper end portion of the partition wall therein; and a leakage checking hole which is formed in the partition inserting groove so as to pass therethrough.

Preferably, an upper portion of the tank where the partition inserting groove is formed has a 'W' shaped cross-section.

Preferably, a clad sheet which forms the header is folded so as to protrude the middle portion thereof and the protruded portion forms the partition wall.

Preferably, a tab part is formed at a position of an upper end portion which corresponds to the leakage checking hole, and the tab part has a size smaller than the size of the leakage checking hole and is inserted into the leakage checking hole.

Preferably, the tab part is formed with a protrusion and a braizing is performed in the state that the protrusion is coupled in a snap-in manner to the leakage checking hole.

DETAILED DESCRIPTION OF MAIN ELEMENTS

| | |
|---|---|
| 10: tank | |
| 11: partition inserting groove | |
| 12: leakage checking hole | |
| 20: header | 21: tube inserting hole |
| 22: partition wall | 23: tab |
| 24: protrusion | 30: tube |
| 31: flow path for heat exchange medium | |
| 40: radiating fin | |

BEST MODE FOR CARRYING OUT THE INVENTION

Hereinafter, the embodiments of the present invention will be described in detail with reference to accompanying drawings.

Figure 1:
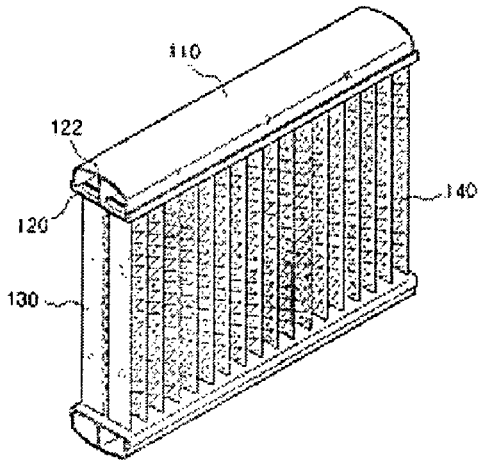
Fig. 1 (PRIOR ART)
FIG. 1 is a perspective view illustrating a conventional heat exchanger.
Figure 2:
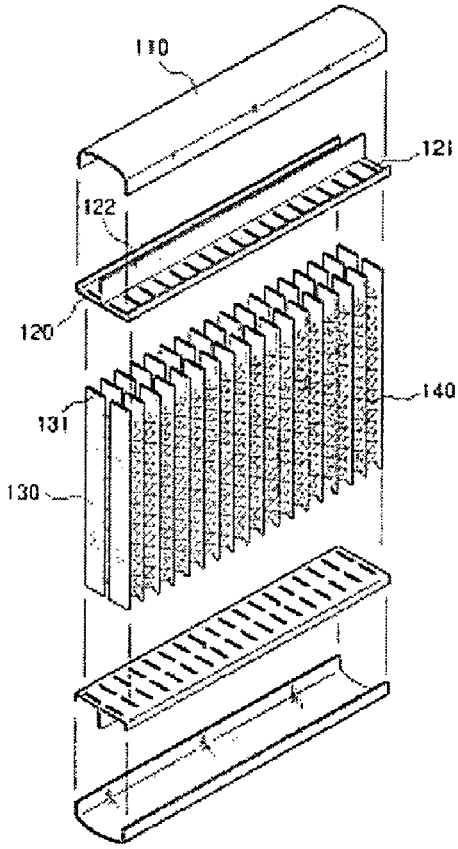
Fig. 2 (PRIOR ART)
FIG. 2 is an exploded perspective view illustrating the conventional heat exchanger.
Figure 3:
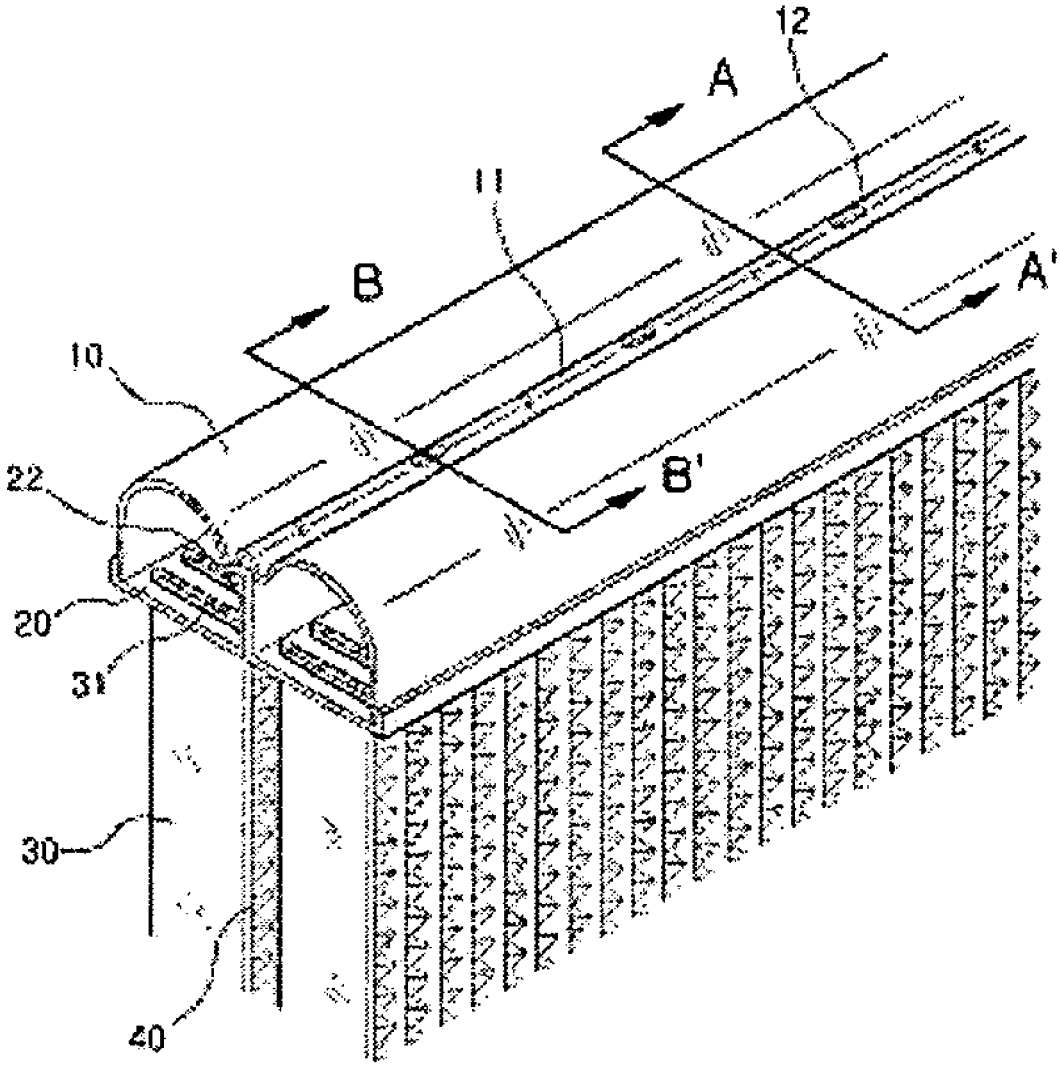
FIG. 3 is a perspective view illustrating a heat exchanger according to an embodiment of the present invention.
Figure 4:
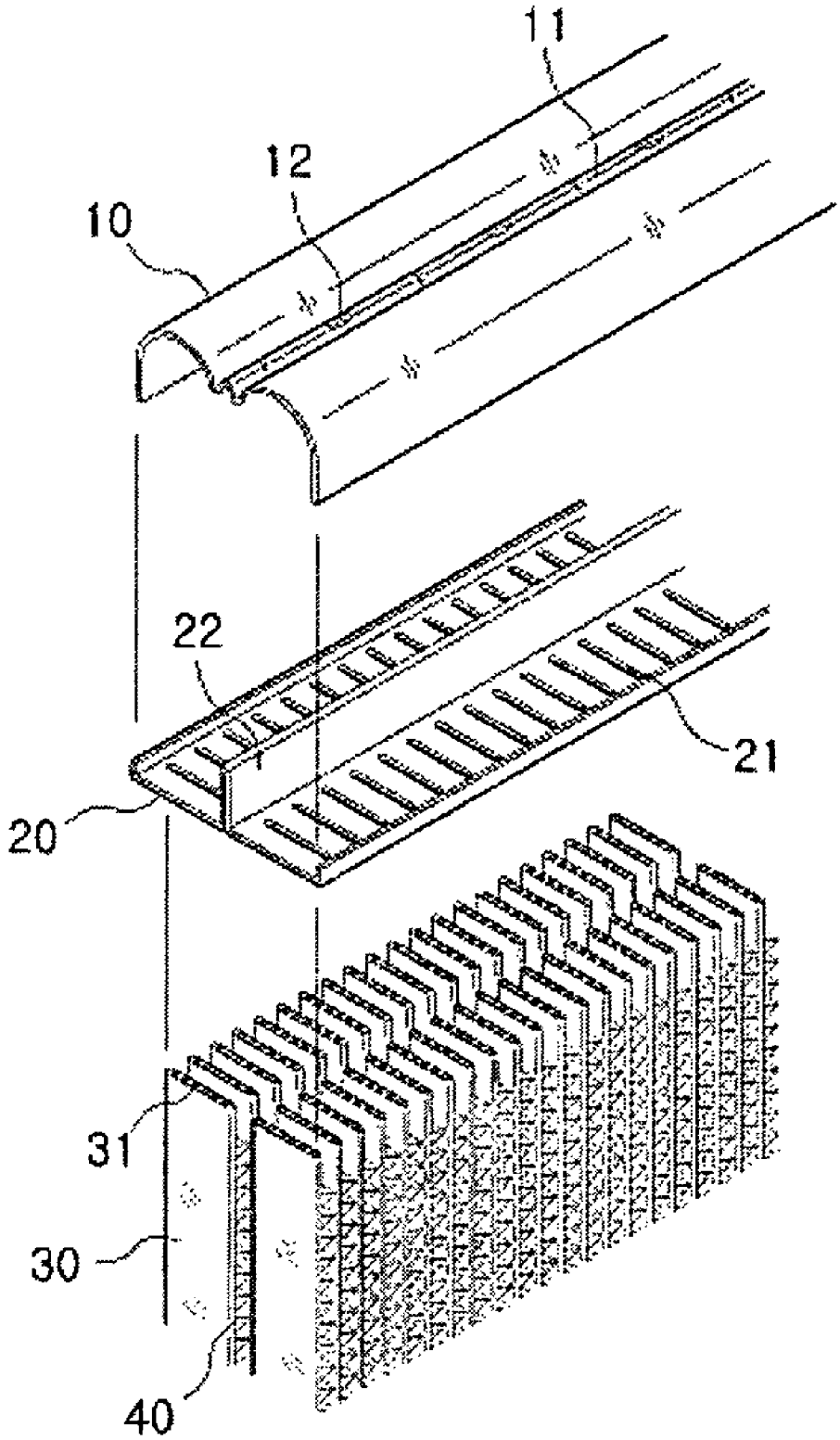
FIG. 4 is an exploded perspective view illustrating heat exchanger according to an embodiment of the present invention.
Figure 5:
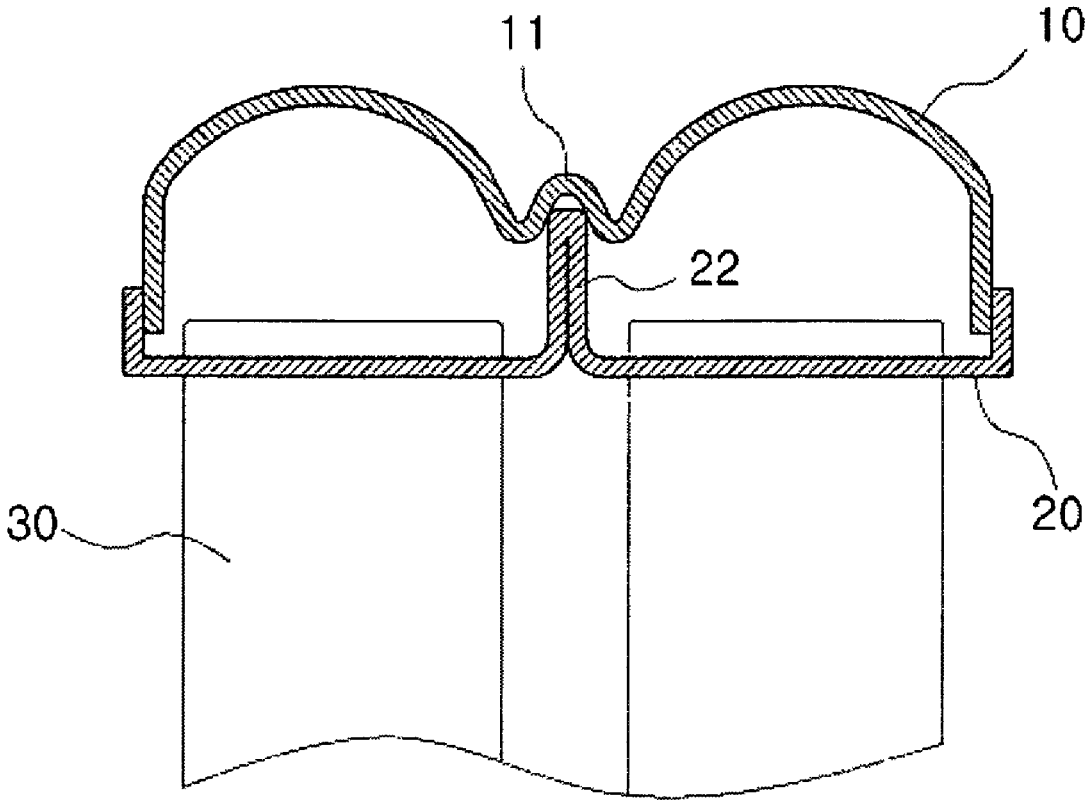
FIG. 5 is a cross-sectional view taken along a line A-A in FIG. 3.
Figure 6:
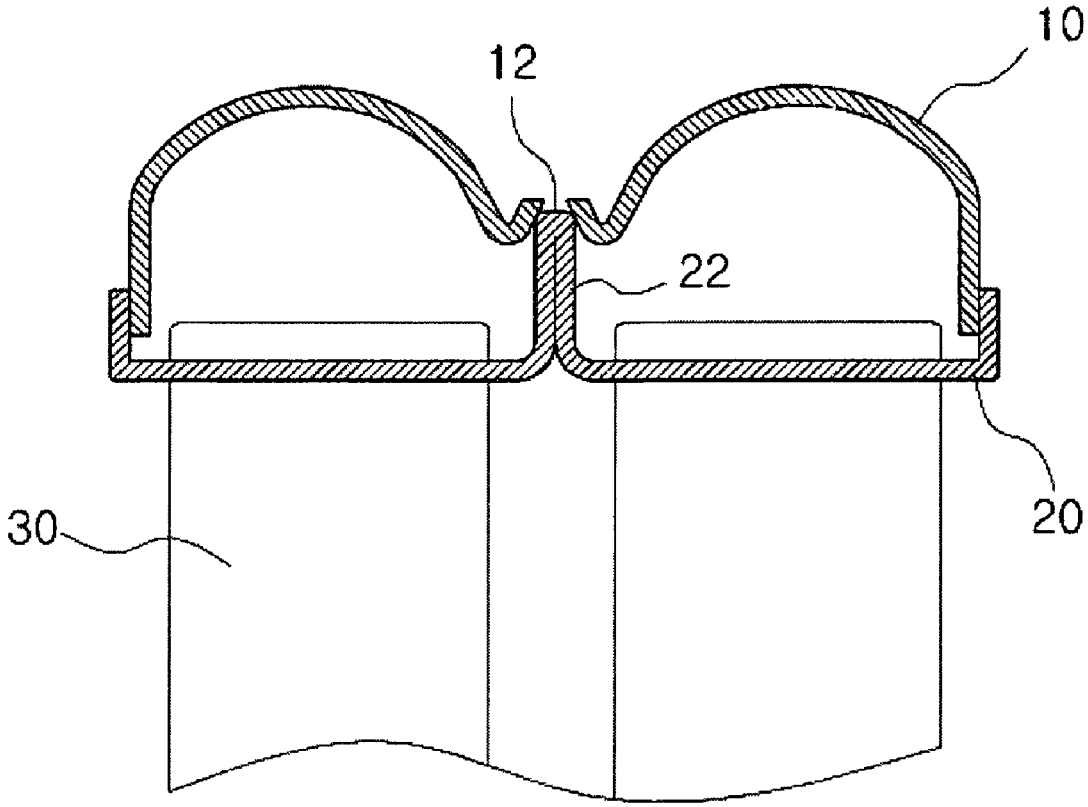
FIG. 6 is a cross-sectional view taken along a line B-B in FIG. 3.
Figure 7:
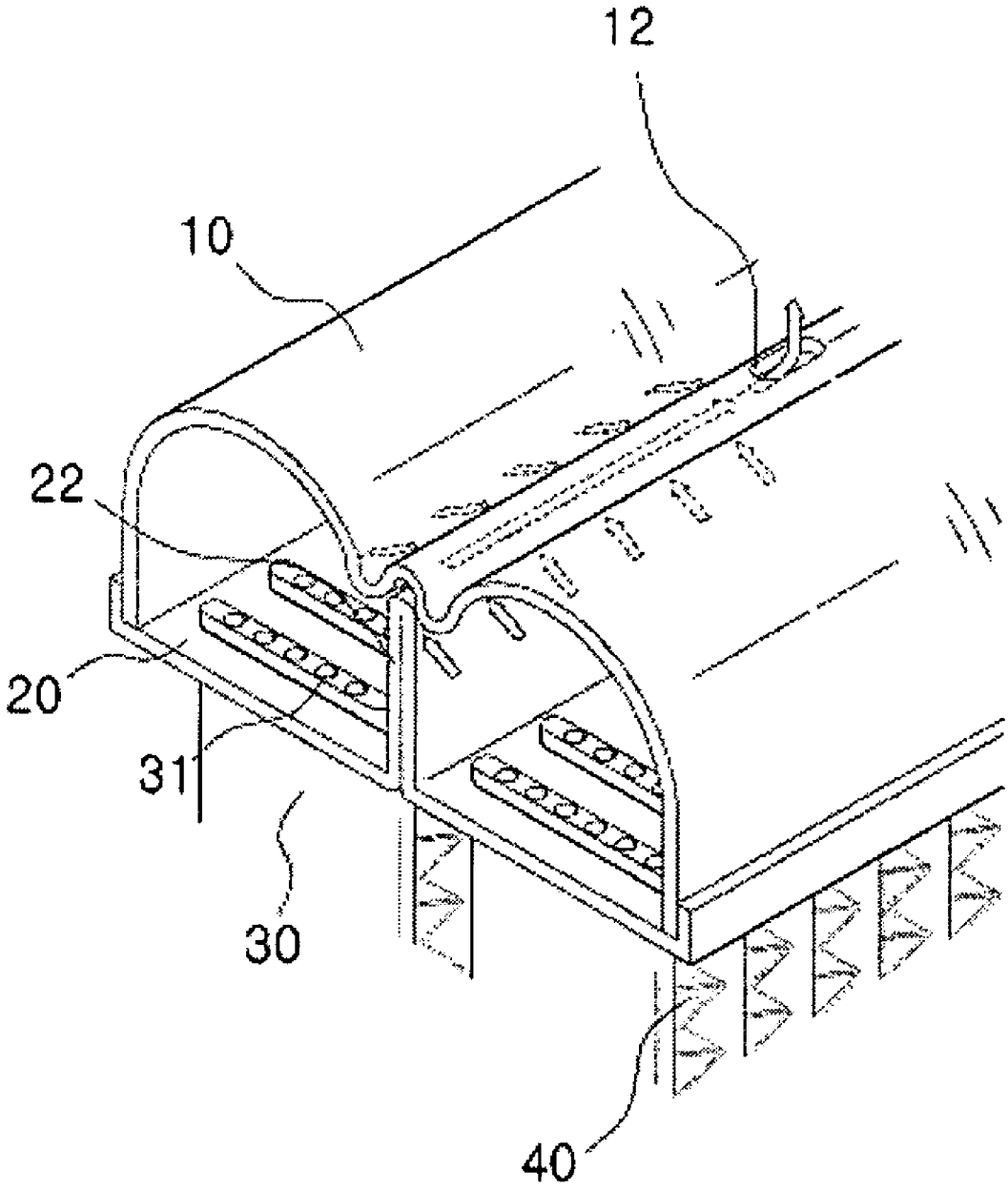
FIG. 7 is a view illustrating a leakage test for the heat exchanger according to an embodiment of the present invention.
Figure 8:
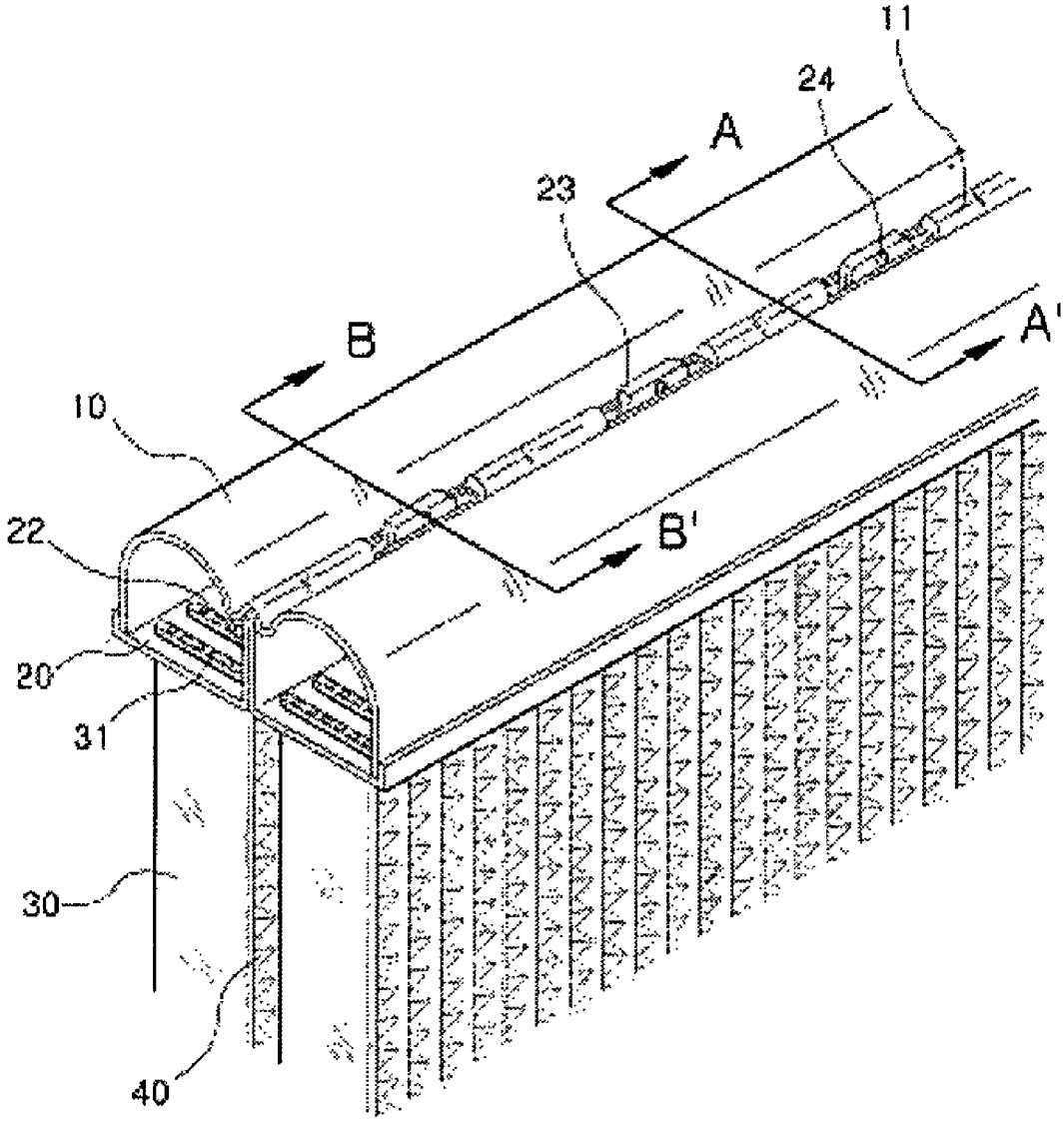
FIG. 8 is a perspective view illustrating a heat exchanger according to another embodiment of the present invention.
Figure 9:
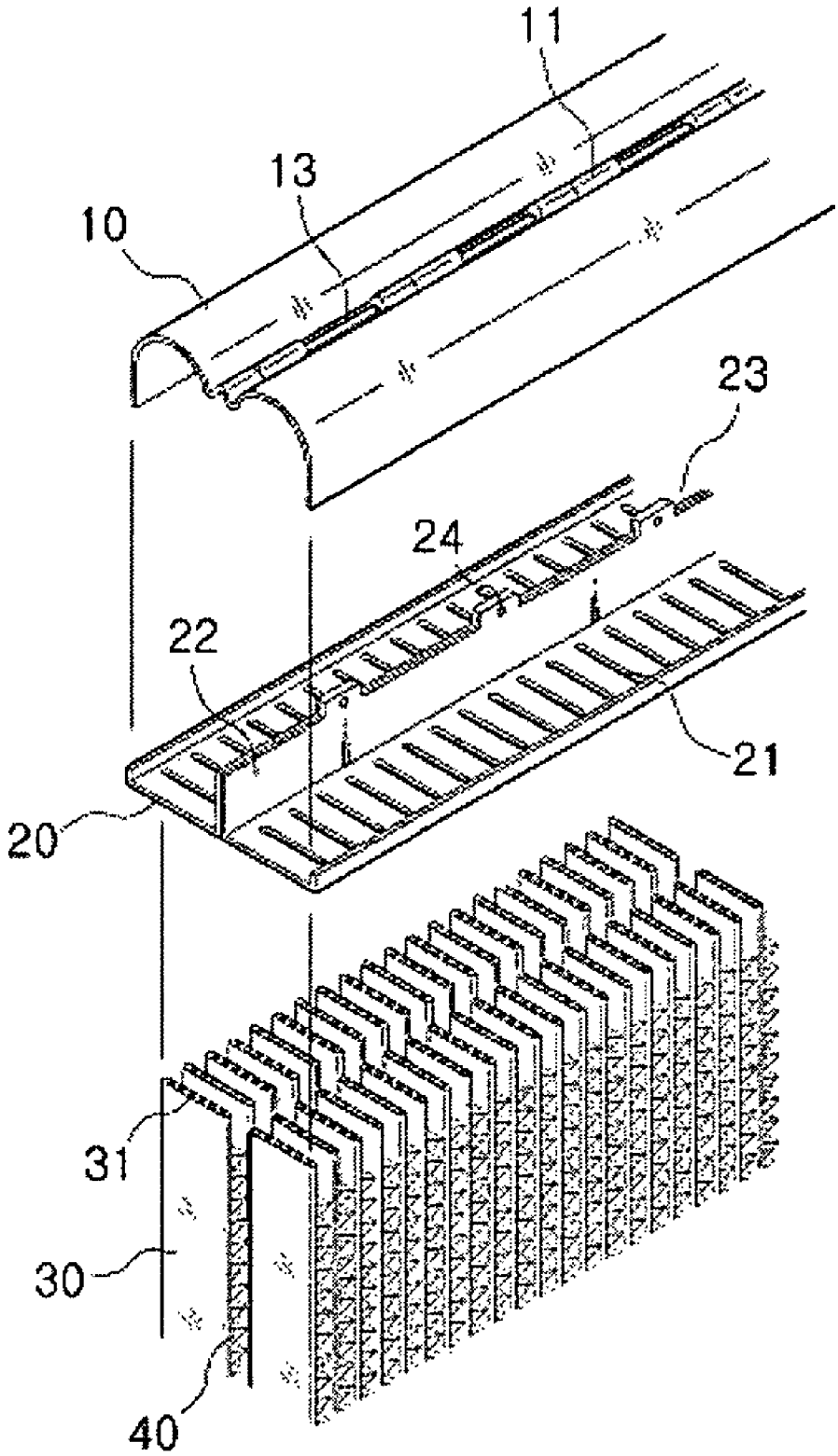
FIG. 9 is an exploded perspective view illustrating heat exchanger according to another embodiment of the present invention.
Figure 10:
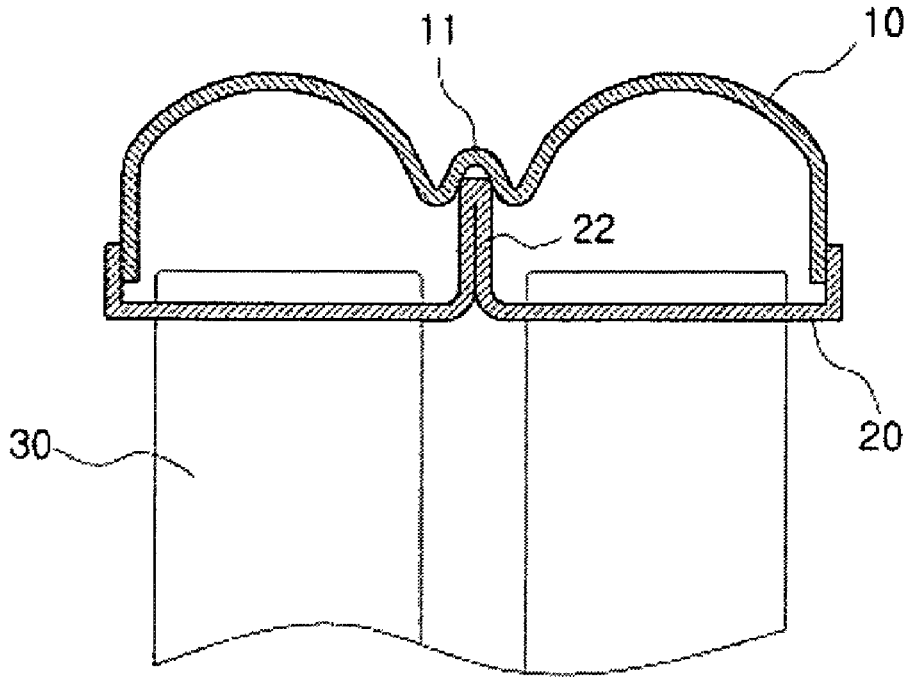
FIG. 10 is a cross-sectional view taken along a line A-A in FIG. 8.
Figure 11:
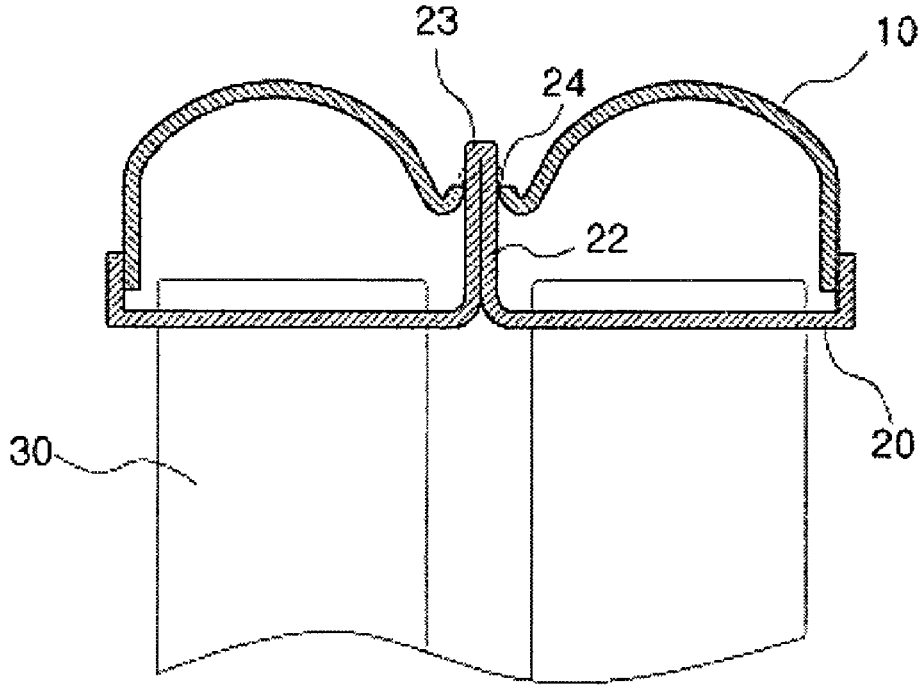
FIG. 11 is a cross-sectional view taken along a line B-B in FIG. 8.
Figure 12:
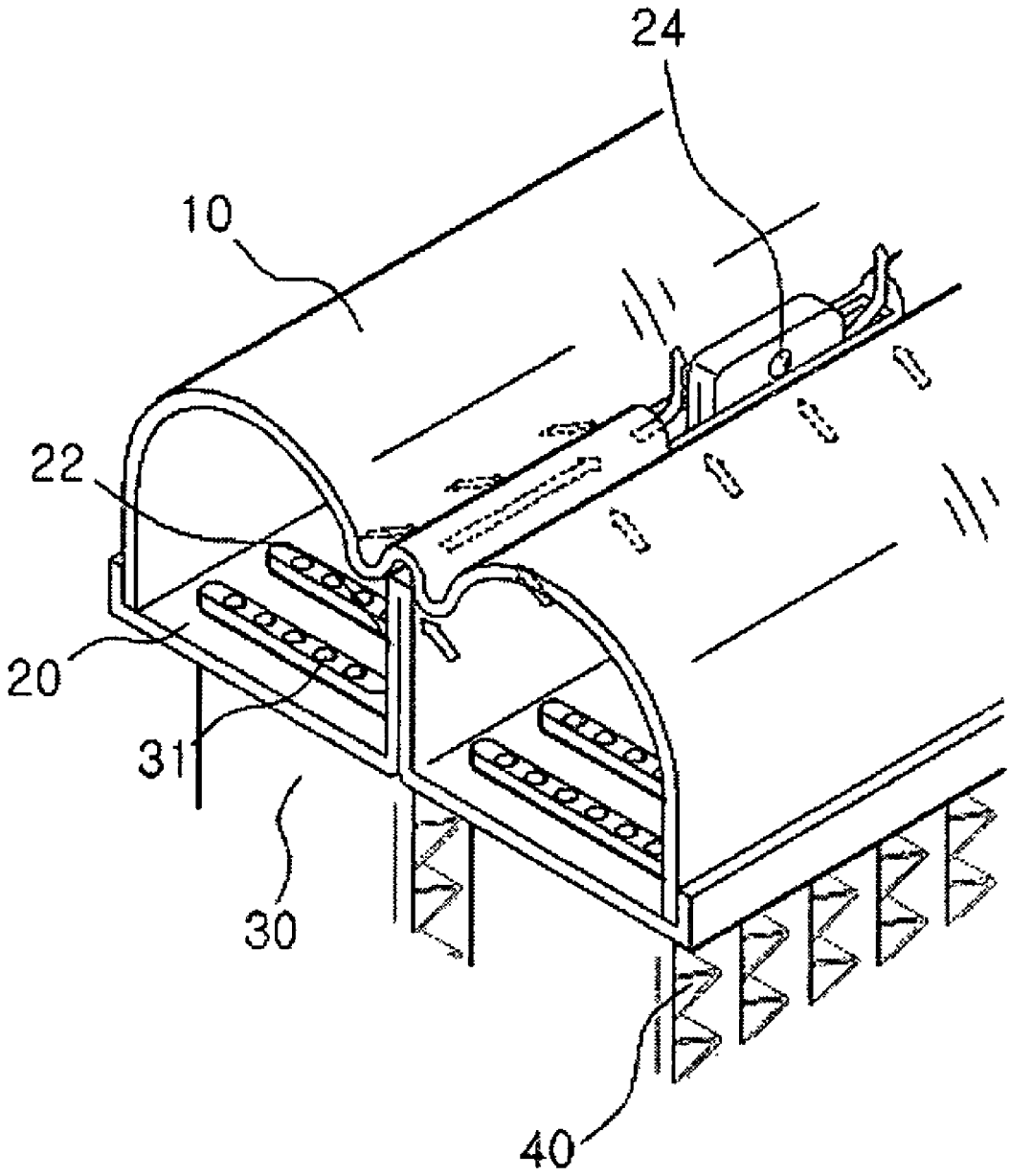
FIG. 12 is a view illustrating a leakage test for the heat exchanger according to another embodiment of the present invention.

FIG. 3 is a perspective view illustrating a heat exchanger according to an embodiment of the present invention; FIG. 4 is an exploded perspective view illustrating heat exchanger according to an embodiment of the present invention; FIG. 5 is a cross-sectional view taken along a line A-A in FIG. 3; FIG. 6 is a cross-sectional view taken along a line B-B in FIG. 3; FIG. 7 is a view illustrating a leakage test for the heat exchanger according to an embodiment of the present invention; FIG. 8 is a perspective view illustrating a heat exchanger according to another embodiment of the present invention; FIG. 9 is an exploded perspective view illustrating heat exchanger according to another embodiment of the present invention; FIG. 10 is a cross-sectional view taken along a line A-A in FIG. 8; FIG. 11 is a cross-sectional view taken along a line B-B in FIG. 8; and FIG. 12 is a view illustrating a leakage test for the heat exchanger according to another embodiment of the present invention.

FIGS. 3 and 4 illustrate a heat exchanger according to an embodiment of the present invention and FIGS. 5 and 6 illustrate cross-sections of the heat exchanger according to an embodiment of the present invention. The heat exchanger includes a plurality of tubes 30 formed with a flow path 31 for a heat exchange medium therein, a plurality of radiating fins 40 interposed between the tubes 30 so as to improve heat exchange efficiency, headers 20 which are formed with a plurality of tube inserting holes 21 into which eath end portions of the tube 30 is fixedly inserted, tanks 10 coupled with an upper portion of the headers 20 to form a passage for the heat exchange medium and at least one partition wall 22 for partitioning a space of the passage for the heat exchange medium.

Herein, the partition wall 22 for partitioning the passage for the heat exchange medium is formed in such a manner that a clad sheet which forms the header 20 is folded so as to protrude the middle portion thereof.

An upper end portion of the partition wall 22 integrally formed with the header 20 is joined to an inside surface of the tank 10 to partition the passage for the heat exchange medium. At this time, in order that the upper end portion of the partition wall 22 and the inside surface of the tank 10 are securely joined, a partition inserting groove 11 is formed long in the tank 10 and the upper end portion of the partition wall 22 is jointly inserted into the partition inserting groove 11.

As such, since the upper end portion of the partition wall 22 formed integrally with the header 20 is jointly inserted into the partition inserting groove 11 which is formed long in the tank 10, a joint area is increased and a joint efficiency is thus improved. Therefore, there is an advantage that it is possible to keep a perfect sealing between the passages for the heat exchange medium partitioned by the partition wall 22.

Also, since an upper portion of the tank 10 where the partition inserting groove 11 is formed has a 'W' shaped cross-section, there is an advantage that misassembly is prevented as the partition wall 22 is guided to the partition inserting groove 11 by the shape of the tank 10 in the process of inserting the partition wall 22 into the partition inserting groove 11.

In the partition inserting groove 11 into which the upper end portion of the partition wall 22, a leakage checking hole 12 which passes through from the inside of the partition inserting groove 11 to the outside of the partition inserting groove 11 is formed.

As shown in the drawings, the leakage checking hole 12 is formed in such a manner that some portion of the partition inserting groove 11 is removed so as to expose a space between an upper surface of the partition wall 22 inserted into the partition inserting groove 11 and the partition inserting groove 11 to the outside.

A leakage test for a general heat exchanger is performed in such a manner that a gas with a specific property is injected into the heat exchanger and then whether the gas is detected in the outside of the heat exchanger is monitored.

By using the aforementioned method, it has been easy to check the leakage for the outside surface of the heat exchanger, but it has been difficult to check the leakage for a portion such as a joined state between the partition wall 22 and the tank 10 which are not exposed to the outside.

Accordingly, in the present invention, since the leakage checking hole 12 is formed to pass through from the space between the upper surface of the partition wall 22 and the partition inserting groove 11 to the outside, a leakage between the passages for the heat exchange medium partitioned by the partition wall 22 can be easily checked in the process of leakage test or using of the heat exchanger.

FIG. 7 is a view illustrating a leakage test for the heat exchanger according to an embodiment of the present invention. When a leakage occurs in the position where the upper end portion of the partition wall 22 and the partition inserting groove 11 are in contact with each other due to a poor brazing or damage of the partition wall 22 and the tank 10, the leakage checking gas is leaked to the outside through the space between the partition wall 22 and the partition inserting groove 11 and the leakage checking hole 12 adjacent thereto as shown, and it is therefore possible to easily check the leakage of the heat exchanger.

With the formation of the leakage checking hole 12 in the partition inserting groove 11, there are advantages that it is possible not only to check the leakage of the heat exchanger, but also to prevent generation of defects due to air, molten metal solution or molten flux solution generated in the process of manufacturing the heat exchanger since the air staying in the space between the upper end portion of the partition wall 22, or the molten metal solution or the molten flux solution generated in the brazing process is naturally discharged to the outside through the leakage checking hole 12 in the process of manufacturing the heat exchanger.

It is preferable that a plurality of the leakage checking holes 12 is formed in a longitudinal direction of the tank 10 as shown so as to facilitate the leakage check.

The shape of the leakage checking hole 12 is not limited to the shown shape and may be modified in any shape which facilitates the leakage check for the heat exchange medium by those skilled in the art.

FIGS. 8 and 9 illustrate a heat exchanger according to another embodiment of the present invention and FIGS. 10 and 11 illustrate cross-sections of the heat exchanger according to another embodiment of the present invention. The heat exchanger includes a plurality of tubes 30 formed with a flow path 31 for a heat exchange medium therein, a plurality of radiating fins 40 interposed between the tubes 30 so as to improve heat exchange efficiency, headers 20 which are formed with a plurality of tube inserting holes 21 into which each end portion of the tube 30 is fixedly inserted, a tanks 10 coupled with an upper portion of the headers 20 to form a passage for the heat exchange medium and at least one partition wall 22 for partitioning a space of the passage for the heat exchange medium.

Herein, the partition wall 22 for partitioning the passage for the heat exchange medium is formed integrally with the header 20 in a longitudinal direction of the header 20 and a partition inserting groove 11 is formed long in the tank 10.

At this time, the partition wall 22 is formed in such a manner that a clad sheet which forms the header 20 is folded so as to protrude the middle portion thereof and a predetermined portion of the protruded portion is then removed to form a tab 23.

A plurality of the tab 23 is formed at regular distances and a plurality of leakage checking holes 12 which passes through from the inside of the partition inserting groove 11 to the outside of the partition inserting groove 11 so as to allow the tab 23 to pass through are formed.

The tab 23 formed in the partition wall 22 passes through the leakage checking hole 12 of the partition inserting groove 11 and the upper end portion except for the tab 23 is jointly inserted into the partition inserting groove 11.

At this time, the tab part 23 is provided with a protrusion 24 and the protrusion 24 is coupled in a snap-in manner to the leakage checking hole 12 in the process of manufacturing the heat exchanger. With the snap of the protrusion 24 in the leakage checking hole 12 in the process of the inserting the tab 23 into the leakage checking hole 12, the joint portion is fixed prior to a brazing process and thus the manufacture of the heat exchanger is facilitated.

Also, since an upper portion of the tank 10 where the partition inserting groove 11 is formed has a 'W' shaped cross-section, there is an advantage that misassembly is prevented as the partition wall 22 is guided to the partition inserting groove 11 by the shape of the tank 10 in the process of inserting the partition wall 22 into the partition inserting groove 11.

Since the upper end portion and the tab 22 of the partition wall 22 formed integrally with the header 20 are jointly inserted into the partition inserting groove 11 formed in the tank 10 and the leakage checking hole 12 formed in the partition inserting groove 11 respectively, the joint area is increased. Therefore, a joint efficiency is improved and it is possible to keep a perfect sealing between the passages for the heat exchange medium partitioned by the partition wall 22.

Herein, the tab 23 is formed smaller than the leakage checking hole 12 and it is thus possible to check easily the leakage of the heat exchanger through the space between the tab part 23 and the leakage checking hole 12.

FIG. 12 is a view illustrating a leakage test for the heat exchanger according to another embodiment of the present invention. When a leakage occurs in the position where the upper end portion of the partition wall 22 and the partition inserting groove 11 are in contact with each other due to a poor brazing or damage of the partition wall 22 and the tank 10, the leakage checking gas is leaked to the outside through the space between the partition wall 22 and the partition inserting groove 11 and the leakage checking hole 12 adjacent thereto as shown, and it is therefore possible to easily check the leakage of the heat exchanger.

With the leakage checking hole 12, there are advantages that it is possible not only to check the leakage of the heat exchanger, but also to prevent generation of defects due to air, molten metal solution or molten flux solution generated in the process of manufacturing the heat exchanger since the air staying in the space between the upper end portion of the partition wall 22, or the molten metal solution or the molten flux solution generated in the brazing process is naturally discharged to the outside through the leakage checking hole 12 in the process of manufacturing the heat exchanger.

The shapes of the leakage checking hole 12 and the tab 23 are not limited to the shown shapes and may be modified in any shapes which facilitates the leakage check for the heat exchange medium by those skilled in the art.

In the manufacture of the header 20 formed with the integrated partition wall 22, the middle portion of the clad sheet may be protrusively folded to manufacture the header 20 formed with the integrated partition wall 22, or a clad sheet formed with the partition wall 22 and a clad sheet without the partition wall 22 may be joined with each other to form a single head 20.

Alternatively, two clad sheets formed with the partition wall 22 may be joined with each other to form a single head 20.

INDUSTRIAL APPLICABILITY

According to the present invention, since the joint area is increased by the partition inserting groove formed in the tank, the tank and the partition wall are securely joined.

Also, since an upper portion of the tank where the partition inserting groove is formed has a 'W' shaped cross-section, there is an advantage that misassembly is prevented as the partition wall is guided to the partition inserting groove by the shape of the tank in the process of inserting the partition wall into the partition inserting groove.

Further, according to the present invention, it is easy to check the leakage between the tank and the partition wall through the leakage checking hole formed in the partition inserting groove.

In addition, since impurities generated in the process of manufacturing the heat exchanger is not stayed in the partition wall and the partition inserting groove but discharged to the outside through the leakage checking hole, the manufacture of the heat exchanger is facilitated and the productivity is thus improved.

The invention claimed is:

1. A heat exchanger, comprising:

a plurality of tubes which are arranged in parallel at a predetermined distance to be parallel with the direction of air flow and used as a flow path for a heat exchange medium;

a plurality of radiating fins which are interposed between the tubes;

headers which are formed with a plurality of tube inserting holes into which each end portion of the tube is fixedly inserted;

tank which is coupled with an upper portion of the headers and used as a passage for the a heat exchange medium;

at least one partition wall which is integrally formed with the header and partitions the passage for the heat exchange medium;

a partition inserting groove which is formed in a longitudinal direction of the tank so as to jointly insert the upper end portion of the partition wall therein; and a leakage checking hole formed through the partition inserting groove and arranged to fluidly connect a space to outside of the tank, wherein the space is formed between the partition inserting groove and an upper surface of the partition wall inserted into the partition inserting groove whereby leaks are directed into and through said space to said leak checking hole for easy detection of leaks.

2. The heat exchanger according to claim 1, wherein an upper portion of the tank where the partition inserting groove is formed has a 'W' shaped cross-section.

3. The heat exchanger according to claim 1, wherein a clad sheet which forms the header is folded so as to protrude the middle portion thereof and the protruded portion forms the partition wall.

4. The heat exchanger according to claim 1, wherein a tab is formed at a position of an upper end portion which corresponds to the leakage checking hole, and the tab has a size smaller than the size of the leakage checking hole and is inserted into the leakage checking hole.

5. The heat exchanger according to claim 4, wherein the tab is formed with a protrusion and a brazing is performed in the state that the protrusion is coupled in a snap-in manner to the leakage checking hole.

6. The heat exchanger according to claim 1, wherein the leakage checking hole is formed in such a manner that a portion of the partition inserting groove is removed so as to expose the space formed between the partition inserting groove and the upper surface of the partition wall to the outside of the tank.

7. The heat exchanger according to claim 1, comprising a plurality of leakage checking holes, each of the leakage checking holes being formed in a longitudinal direction of the tank.

* * * * *